US009675188B1

(12) United States Patent
Lueken

(10) Patent No.: US 9,675,188 B1
(45) Date of Patent: Jun. 13, 2017

(54) SHOPPING CART CORRALS WITH AT LEAST TWO ADVERTISEMENT PANELS ARRANGED IN A STAGGERED FASHION AND METHOD OF PROVIDING SAME

(71) Applicant: Starlite Media, LLC, New York, NY (US)

(72) Inventor: Harold W. Lueken, New York, NY (US)

(73) Assignee: Starlite Media, LLC, New York, NY (US)

( * ) Notice: Subject to any disclaimer, the term of this patent is extended or adjusted under 35 U.S.C. 154(b) by 11 days.

(21) Appl. No.: 14/843,771

(22) Filed: Sep. 2, 2015

Related U.S. Application Data

(63) Continuation of application No. 14/601,030, filed on Jan. 20, 2015, now Pat. No. 9,301,627, which is a continuation of application No. 13/205,594, filed on Aug. 8, 2011, now Pat. No. 8,984,782, which is a continuation-in-part of application No. 29/357,739, filed on Mar. 16, 2010, now abandoned.

(51) Int. Cl.

| | |
|---|---|
| ***A47F 7/00*** | (2006.01) |
| ***A47F 10/04*** | (2006.01) |
| ***G09F 23/00*** | (2006.01) |

(52) U.S. Cl.
CPC ..... *A47F 10/04* (2013.01); *G09F 23/00* (2013.01); *A47F 7/00* (2013.01)

(58) Field of Classification Search
CPC ..... A47F 7/00
USPC ..... 40/606.03, 606.13, 606.14, 642.01, 612, 40/624; 211/17, 22; 256/25; 248/225.11
See application file for complete search history.

(56) References Cited

U.S. PATENT DOCUMENTS

| | | | |
|---|---|---|---|
| D31,832 | S | 11/1899 | Marcus |
| 1,927,997 | A | 9/1933 | Weston |
| 2,165,724 | A | 7/1939 | Le Moyne Page et al. |
| 2,985,316 | A | 5/1961 | Ruhnke |
| 3,323,655 | A | 6/1967 | Foran et al. |
| D219,946 | S | 2/1971 | Birnberg |

(Continued)

FOREIGN PATENT DOCUMENTS

| | | |
|---|---|---|
| CA | 2848905 | 3/2013 |
| CN | 203054922 | 7/2013 |

(Continued)

OTHER PUBLICATIONS

RFID Technology [online], [retrieved Feb. 14, 2013]. Retrieved from the Internet: <URL: http://www.vorelco.com/services/rfid-technology>, 16 pages.

(Continued)

*Primary Examiner* — Syed A Islam
(74) *Attorney, Agent, or Firm* — Bryan Cave LLP

(57) ABSTRACT

Certain embodiments disclose a corral and enclosure defined by three members having an opening configured to hold one or more shopping carts and display one or more advertisements, with two substantially parallel walls of different lengths and advertisement panels affixed on the walls, such that they are staggered. The staggered arrangement of the at least two advertisement panels facilitates better visibility and allows the simultaneous viewing of at least two advertisement panels. The longer member also further protects vehicles parked on its side from colliding with shopping carts.

18 Claims, 9 Drawing Sheets

(56) References Cited

U.S. PATENT DOCUMENTS

| | | | | |
|---|---|---|---|---|
| 3,722,702 | A | 3/1973 | Marker, Jr. | |
| 4,236,697 | A | 12/1980 | Savino | |
| 4,292,352 | A | 9/1981 | Singer | |
| 4,364,192 | A | 12/1982 | Lloyd | |
| D269,978 | S | 8/1983 | Dickson | |
| 4,609,183 | A | 9/1986 | Ulmer | |
| D286,074 | S | 10/1986 | Corte | |
| 4,777,750 | A | 10/1988 | Garfinkle | |
| 4,884,353 | A | 12/1989 | Taylor | |
| 4,918,878 | A | 4/1990 | Paschke et al. | |
| 4,957,256 | A * | 9/1990 | Boeding | G09F 1/10 248/225.11 |
| D321,798 | S | 11/1991 | Buckley | |
| 5,082,087 | A | 1/1992 | Hubbell | |
| D334,301 | S | 3/1993 | Buckley | |
| 5,201,426 | A | 4/1993 | Cruwell | |
| 5,220,740 | A | 6/1993 | Brault | |
| 5,279,085 | A | 1/1994 | DiPaolo et al. | |
| D350,038 | S | 8/1994 | Buckley | |
| D361,448 | S | 8/1995 | Buckley | |
| 5,551,578 | A | 9/1996 | McCue et al. | |
| D376,854 | S | 12/1996 | DiPaolo et al. | |
| 5,626,926 | A | 5/1997 | Roberts | |
| 5,708,782 | A | 1/1998 | Larson et al. | |
| 5,862,921 | A | 1/1999 | Venegas | |
| 5,875,578 | A | 3/1999 | Grewe | |
| 5,878,518 | A | 3/1999 | Grewe | |
| D430,901 | S | 9/2000 | Palmer | |
| 6,298,997 | B1 * | 10/2001 | Jarrett | A47F 10/04 211/17 |
| 6,449,888 | B1 | 9/2002 | Gibbs | |
| 6,493,997 | B2 | 12/2002 | Cohen | |
| 6,581,616 | B1 | 6/2003 | Venegas | |
| D488,904 | S | 4/2004 | Unnerstall et al. | |
| D492,732 | S | 7/2004 | Herbst | |
| D495,011 | S | 8/2004 | Trubiano | |
| D497,167 | S | 10/2004 | Ozolins et al. | |
| 6,975,205 | B1 | 12/2005 | French et al. | |
| 7,044,446 | B2 | 5/2006 | Hempen et al. | |
| D529,960 | S | 10/2006 | Cox | |
| 7,140,581 | B1 | 11/2006 | White | |
| D537,952 | S | 3/2007 | Anton | |
| D540,472 | S | 4/2007 | Van Es | |
| 7,210,270 | B1 | 5/2007 | King et al | |
| 7,237,360 | B2 | 7/2007 | Moncho et al. | |
| 7,283,650 | B1 | 10/2007 | Sharma et al. | |
| D587,761 | S | 3/2009 | Grimshaw | |
| D588,201 | S | 3/2009 | Kohagen et al. | |
| 7,660,747 | B2 | 2/2010 | Brice et al. | |
| D615,129 | S | 5/2010 | Allen | |
| D620,531 | S | 7/2010 | Allen | |
| 7,894,936 | B2 | 2/2011 | Walker et al. | |
| 7,895,782 | B2 | 3/2011 | Farrell | |
| 8,015,737 | B2 | 9/2011 | Venegas, Jr. | |
| 8,104,671 | B2 | 1/2012 | Besecker et al. | |
| D653,709 | S | 2/2012 | Allen | |
| RE43,233 | E | 3/2012 | Venegas, Jr. | |
| 8,196,326 | B2 | 6/2012 | Frey | |
| 8,205,757 | B2 | 6/2012 | Allen | |
| D663,779 | S | 7/2012 | Lueken | |
| D667,504 | S | 9/2012 | Allen | |
| 8,332,272 | B2 | 12/2012 | Fisher | |
| 8,424,690 | B2 | 4/2013 | Allen | |
| D682,944 | S | 5/2013 | Lueken | |
| D695,835 | S | 12/2013 | Lueken | |
| D695,836 | S | 12/2013 | Lueken | |
| D695,837 | S | 12/2013 | Lueken | |
| D699,789 | S | 2/2014 | Allen | |
| D701,322 | S | 3/2014 | McCue et al. | |
| D703,271 | S | 4/2014 | Lueken | |
| D725,287 | S | 3/2015 | Allen | |
| 8,984,782 | B1 | 3/2015 | Lueken | |
| 8,998,003 | B2 | 4/2015 | McCue et al. | |
| 9,138,081 | B1 | 9/2015 | Allen | |
| 9,301,627 | B1 | 4/2016 | Lueken | |
| 9,301,628 | B1 | 4/2016 | Allen | |
| D756,461 | S | 5/2016 | Lueken | |
| 9,367,859 | B2 | 6/2016 | Lueken | |
| 2003/0115096 | A1 | 6/2003 | Reynolds et al. | |
| 2004/0079934 | A1 | 4/2004 | Hempen et al. | |
| 2004/0225560 | A1 | 11/2004 | Lewis et al. | |
| 2005/0083465 | A1 | 4/2005 | Niiyama et al. | |
| 2008/0040962 | A1 | 2/2008 | Gurren | |
| 2008/0120877 | A1 | 5/2008 | Farrell | |
| 2008/0185888 | A1 | 8/2008 | Beall et al. | |
| 2008/0262928 | A1 | 10/2008 | Michaelis | |
| 2009/0288012 | A1 | 11/2009 | Hertel et al. | |
| 2010/0114683 | A1 | 5/2010 | Wessels et al. | |
| 2010/0327245 | A1 | 12/2010 | Allen | |
| 2011/0047023 | A1 | 2/2011 | Lieblang et al. | |
| 2011/0185607 | A1 | 8/2011 | Forster et al. | |
| 2011/0218942 | A1 | 9/2011 | Scheffer | |
| 2012/0029998 | A1 | 2/2012 | Aversano et al. | |
| 2012/0066068 | A1 | 3/2012 | Pan | |
| 2012/0123826 | A1 | 5/2012 | French et al. | |
| 2012/0209686 | A1 | 8/2012 | Horowitz et al. | |
| 2012/0271715 | A1 | 10/2012 | Morton et al. | |
| 2013/0085835 | A1 | 4/2013 | Horowitz | |
| 2013/0090999 | A1 | 4/2013 | Lellouche | |
| 2013/0091002 | A1 | 4/2013 | Christie et al. | |
| 2013/0159090 | A1 | 6/2013 | Boal | |
| 2013/0204697 | A1 | 8/2013 | Boal | |
| 2013/0332253 | A1 | 12/2013 | Shiffert et al. | |
| 2013/0332258 | A1 | 12/2013 | Shiffert et al. | |
| 2013/0332274 | A1 | 12/2013 | Faith et al. | |
| 2013/0332283 | A1 | 12/2013 | Faith et al. | |
| 2014/0108108 | A1 | 4/2014 | Artman et al. | |

FOREIGN PATENT DOCUMENTS

| | | |
|---|---|---|
| EP | 2273444 | 1/2011 |
| EP | 2487875 | 8/2012 |
| WO | WO 2013/040591 | 3/2013 |
| WO | WO 2013/126894 | 8/2013 |

OTHER PUBLICATIONS

Thinaire Launches the First Ever NFC Enterprise Marketing Platform [online], Sep. 12, 2012, [retrieved Jul. 31, 2014]. Retrieved from the Internet <URL: http://globenewswire.com/news-release/2012/09/12/490308/10004878/en/Thinaire-TM-Launches-the-First-Ever-NFC-Enterprise-Marketing-Platform.html>.

Kraft NFC pilot delivers 12 times the engagement level of QR codes [online], Oct. 18, 2012, [retrieved Jul. 31, 2014]. Retrieved from the Internet <URL: http://www.mobilecommercedaily.com/kraft-nfc-pilot-delivers-12-times-the-engagement-level-of-qr-codes>.

Valassis Launches Electronic Coupon Clearing Platform [online], Oct. 20, 2011, [retrieved Jul. 31, 2014]. Retrieved from the Internet <URL: http://news.thomasnet.com/fullstory/Coupon-Redemption-Software-performs-real-time-validation-604347>.

RFID-Enabled Cart Set to Provide Shoppers With Product Info, Ads [online], Jan. 31, 2007, [retrieved Jul. 31, 2014]. Retrieved from the Internet <URL: http://rfidjournal.com/articles/view?3013>.

Meijer's Smart Carts [online], Nov. 8, 206, [retrieved Jul. 31, 2014]. Retrieved from the Internet <URL: http://www.retailwire.com/discussion/11786/meijers-smart-carts.

Store logistics and payment with NFC [online], Jul. 1, 2006, [retrieved Jul. 31, 2014]. Retrieved from the Internet <URL: http://www.ist-world.org/ProjectDetails.aspx?ProjectId=e89323fb585a4b798bf211f044c71b54&SourceDatabaseId=7cff9226e582440894200b751bab883f>.

Stop & Shop, Scan It! & Scan It! Mobile [online], [retrieved Nov. 1, 2016]. Retrieved from the Internet <URL: http://www.stopandshop.com/scanitmobile>.

Brand.net brochure, Mobile Ads: Any Device / Instant Action.

Stop and Shop, Login [online], [retrieved Aug. 1, 2014]. Retrieved from the Internet <URL: https://www.stopandshop.com/login/?__requestid=88655>.

(56) References Cited

OTHER PUBLICATIONS

Grabert, "Clear Channel Outdoor launches 'Connect,' the first global out-of-home mobile interactive advertising platform" [online], Mar. 25, 2014, [retrieved Aug. 19, 2015]. Retrieved from the Internet <http://company.clearchanneloutdoor.com/clear-channel-outdoor-launches-connect-first-global-home-mobile-interactive-advertising-platform>.

* cited by examiner

SHOPPING CART CORRALS WITH AT LEAST TWO ADVERTISEMENT PANELS ARRANGED IN A STAGGERED FASHION AND METHOD OF PROVIDING SAME

CROSS-REFERENCE TO RELATED APPLICATION

The present application claims benefit to and is a continuation application of U.S. patent application Ser. No. 14/601,030 filed on Jan. 20, 2015, which is a continuation of Ser. No. 13/205,594 filed on Aug. 8, 2011, now, U.S. Pat. No. 8,984,782, which is a continuation-in-part of U.S. patent application Ser. No. 29/357,739, filed Mar. 16, 2010. The contents of these applications are hereby incorporated by reference in their entireties.

FIELD OF THE INVENTION

This invention relates generally to shopping cart corrals that have at least two walls (otherwise referred to as a "side" or "member") of different lengths where at least two advertisement panels can be affixed in a staggered fashion, and the method of providing the same.

DESCRIPTION OF THE BACKGROUND

Businesses provide facilities to allow their customers to have a better experience or shop more comfortably. For example, many stores provide shopping carts for their customers to allow the customers to transport merchandise in their stores and to their vehicles. Stores also provide shopping cart corrals in their parking lots so the stores' customers can return the shopping carts after the customers have transported any purchased merchandise to their vehicles. Providing shopping cart corrals reduces vehicle damage complaints by customers by supplying the customers with a location to return their shopping carts, instead of the customers leaving the shopping carts in unoccupied parking spaces in the stores' parking lots. Shopping carts left in unoccupied parking spaces are more likely to roll (or be accidentally pushed) into a vehicle parked in the parking lot and cause damage to the body or paint of the vehicle, as well as damage the cart. Shopping cart corrals also help keep parking lots organized and reduce shopping cart theft and loss. For similar reasons, airports provide luggage carts for travelers and businesses provide bicycle racks for their customers.

Other structures such as train or bus stop shelters provide customers comfort and protection from the elements while waiting for their transportation. Similarly, telephone booths provide customers comfort, protection and privacy while they make telephone calls.

While these structures and facilities can save the businesses money by reducing shopping and luggage cart loss and claims of vehicle damage, and enhance the customers' experience by avoiding clutters of carts and bicycles outside the stores, and in the case of train or bus stop shelters and telephone booths, by providing them with comfort, protection and privacy, these structures and facilities are expensive to purchase and maintain and provide no direct revenues to the businesses.

Furthermore, these structures and facilities can become worn-out and battered after being exposed to the elements over an extended period of time. These worn-out and battered structures and facilities can be a blemish or eyesore at the front of an otherwise pristine and/or well-maintained business, particularly because they are often located in high traffic areas.

Many of these structures and facilities are constructed with a space created by two aligned walls of equal length where carts and bicycles can be held, or within which customers can stand or sit in the case of train or bus stop shelters and telephone booths (the space is hereinafter referred to as the "enclosure"). Advertisement panels may be affixed on the walls of these structures and facilities, and each panel has two sides, one facing the enclosure, and one facing away from it, both of which can display various advertisements simultaneously. These advertisements generate on-going revenues for the businesses and also make the structures and facilities more attractive.

Examples of shopping cart corrals having aligned walls on which advertising panels are affixed are shown in U.S. application Ser. No. 12/456,875, filed Jun. 24, 2009, the contents of which are hereby incorporated by reference in their entirety.

However, the aligned advertisement panels prevent customers from viewing both panels simultaneously and also from viewing one of the panels in an unobstructed fashion in the event that an object such as a vehicle is parked alongside the panel, when customers approach from the side of the structure or facility, as discussed in more detail below in connection with FIG. 1.

Accordingly, a need or potential for benefit exists for a facility or structure with at least two substantially parallel advertisement panels arranged in a staggered fashion to enhance visibility and allow simultaneous viewing of as many advertisements as possible on the two substantially parallel panels.

BRIEF DESCRIPTION OF THE DRAWINGS

To facilitate further description of the embodiments, the following drawings are provided in which.

Figure 1:
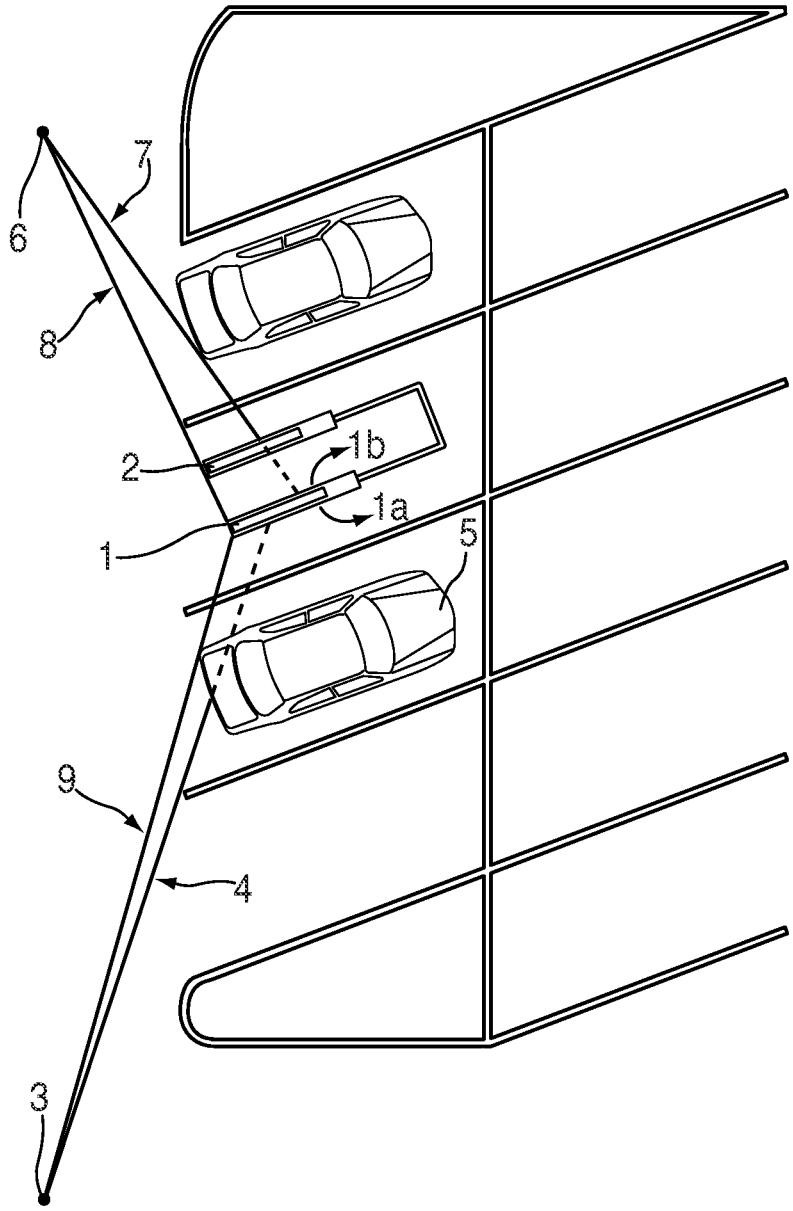
FIG. 1 illustrates an aerial view of a shopping cart corral with two walls of equal length and two advertisement panels in an aligned position.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of certain embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have" and any variations thereof, are intended to cover a non-exclusive inclusion, such that a process, method, system, article, device, corral, or apparatus that comprises a list of elements is not necessarily limited to those elements, but may include other elements not expressly listed or inherent to such process, method, system, article, device, corral, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise. Two or more electrical elements may be electrically coupled but not be mechanically or otherwise coupled; two or more mechanical elements may be mechanically coupled, but not be electrically or otherwise coupled; two or more electrical elements may be mechanically coupled, but not be electrically or otherwise coupled; and two or more mechanical elements may be electrically coupled, but not be mechanically or otherwise coupled. Coupling may be for any length of time, e.g., permanent or semi-permanent or only for an instant.

The absence of the word "removably," "removable," and the like near the word "coupled," and the like does not mean that the coupling, etc. in question is or is not removable.

DETAILED DESCRIPTION OF EXAMPLES OF THE PREFERRED EMBODIMENTS

A shopping cart corral is provided with at least two substantially parallel members that differ in length so that any advertisement panels mounted thereon are staggered. The corral can include: (a) an enclosure having an opening configured to receive one or more shopping carts, the enclosure having a first member that is longer than the member opposite the first; (b) at least one first panel located at the first member and configured to display at least a first advertisement of the one or more advertisements; (c) at least one second panel located at the shorter member opposite the first member and configured to display at least a second advertisement of the one or more advertisements.

Advertising panels are coupled adjacent to the opening of the shopping cart corral enclosure. Locating the panels in such a manner improves visibility of the panels when vehicles are parked near the corrals, and allows the simultaneous viewing of at least two advertisement panels. The longer member also further protects vehicles parked on its side from colliding with shopping carts.

The advertising panels can be configured to hold one or more advertisements that improve the aesthetics of the parking lot and provide visibility in parking lots. Through such increased visibility, customers are able to learn more about products and services of interest, and advertisers are able to make additional commercial impressions in high-traffic areas. In addition, the shopping cart corrals can be used as a revenue stream for the owners of the parking lots, stores and/or corrals.

An apparatus for retaining two or more shopping carts is provided. The apparatus can include: (a) a first member with a first end and a second end opposite the first end, the first member having at least one first advertisement panel configured to display at least one first advertisement; (b) a second member with a first end and a second end opposite the first end, the first end of the second member coupled to the second end of the first member; and (c) a third member that is shorter than the first member with a first end and a second end opposite the first end, the second end of the third member coupled to the second end of the second member. The first member is spaced apart from the third member such that two or more shopping carts can be placed between the first member, the second member, and the third member.

Figure 2:
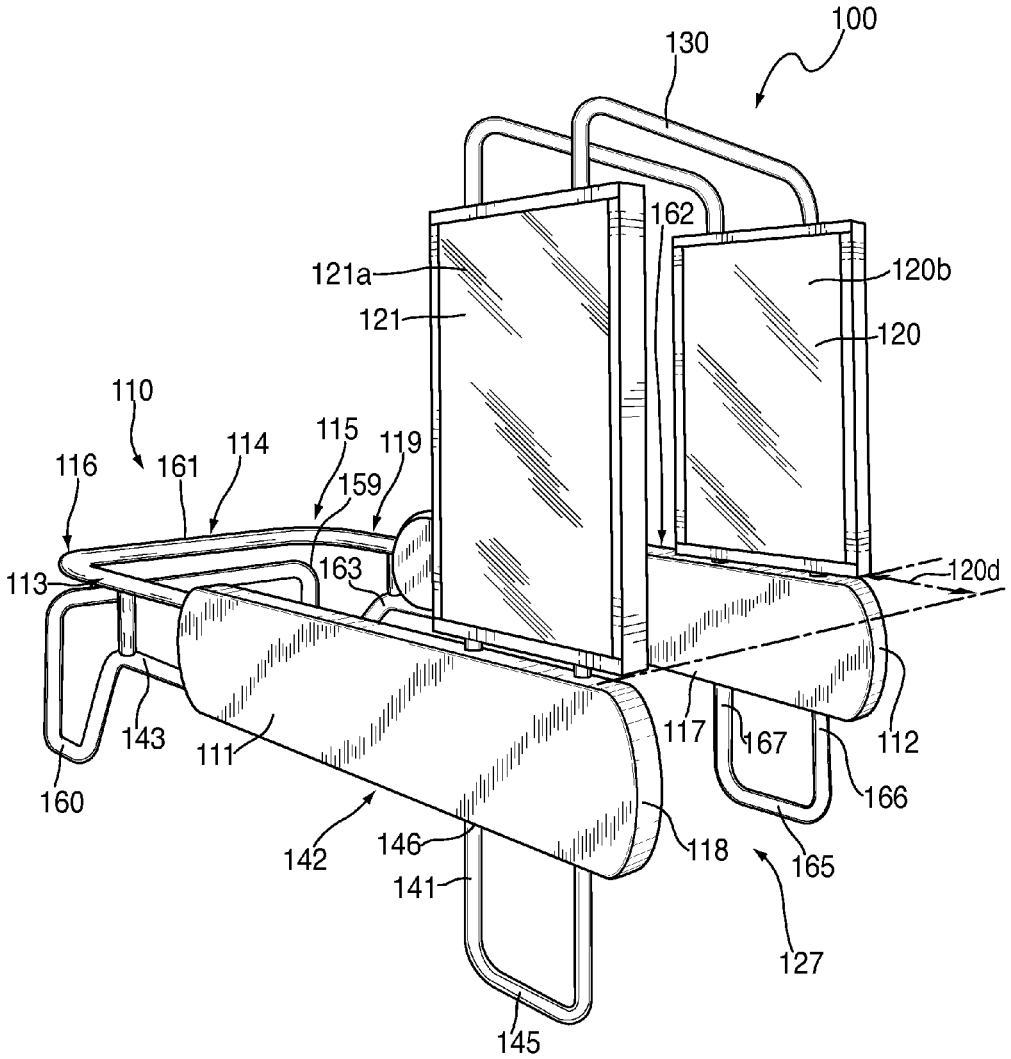
FIG. 2 illustrates a perspective view of the shopping cart corral with two substantially parallel walls that differ in length and two staggered advertisement panels affixed thereon, according to certain embodiments.
Figure 3:
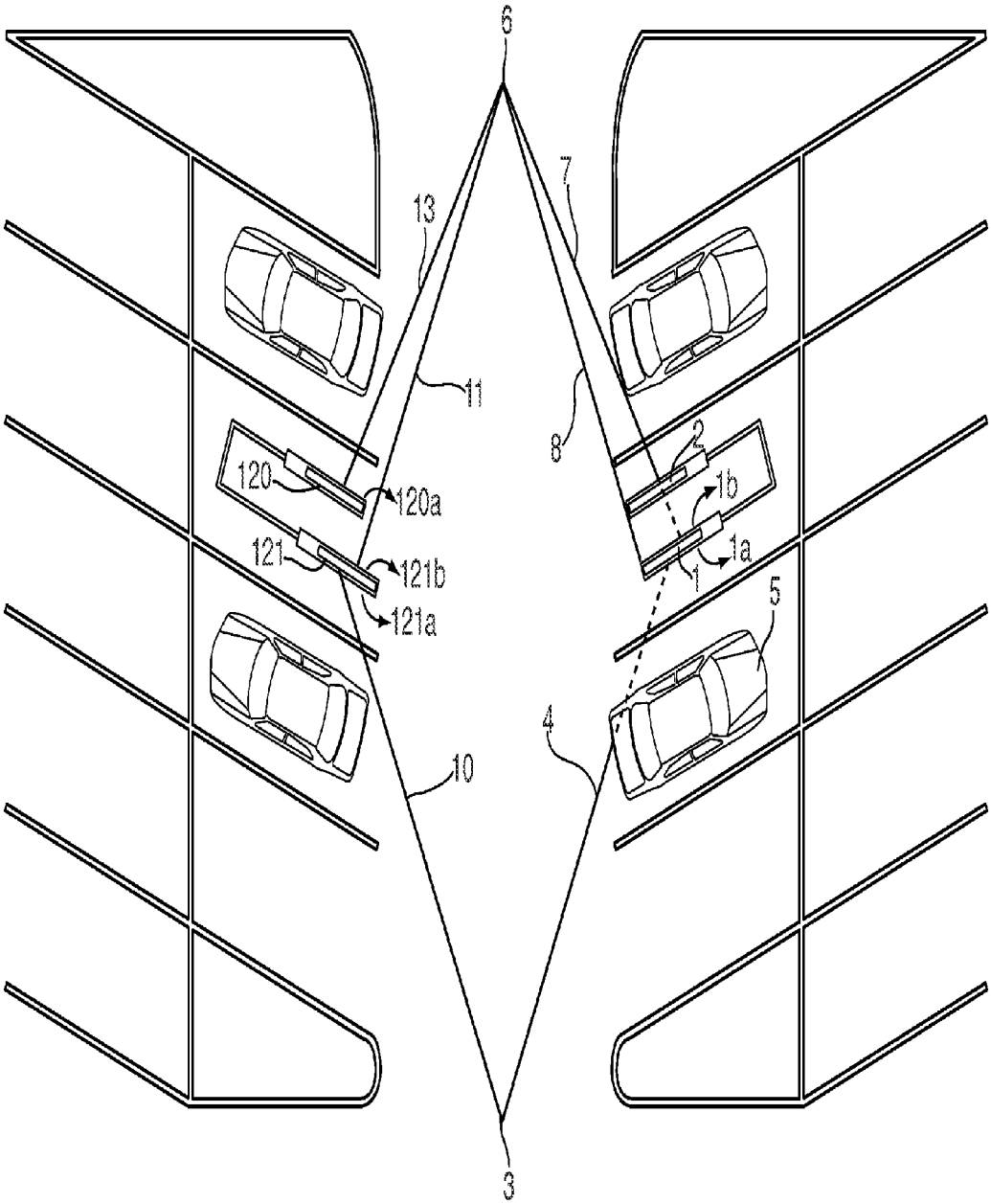
FIG. 3 illustrates an aerial view of the shopping cart corral of FIG. 1 on the right, and a simplified version of the shopping cart corral of FIG. 2 on the left.
Figure 4:
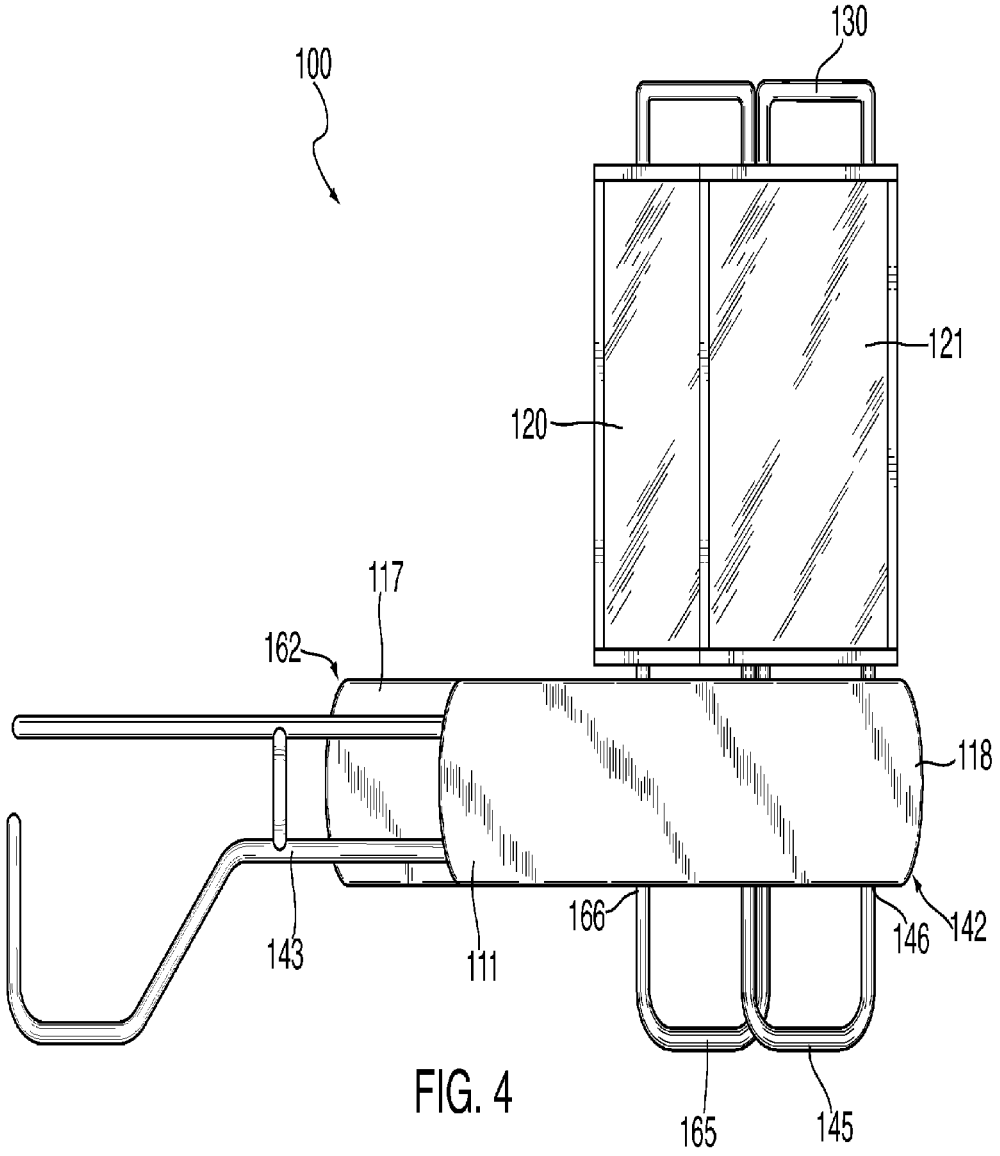
FIG. 4 illustrates a side view of the shopping cart corral of FIG. 2.
Figure 5:
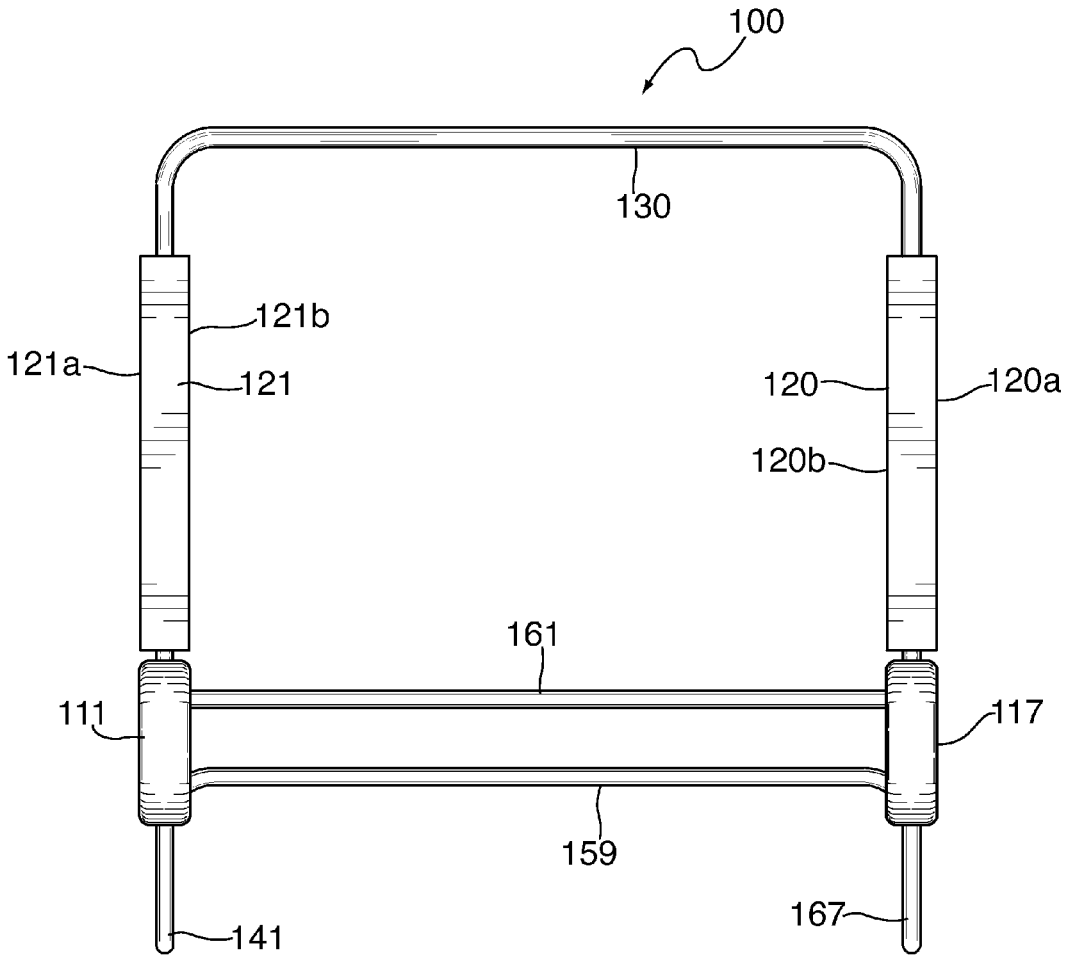
FIG. 5 illustrates a front view of the shopping cart corral of FIG. 2.
Figure 6:
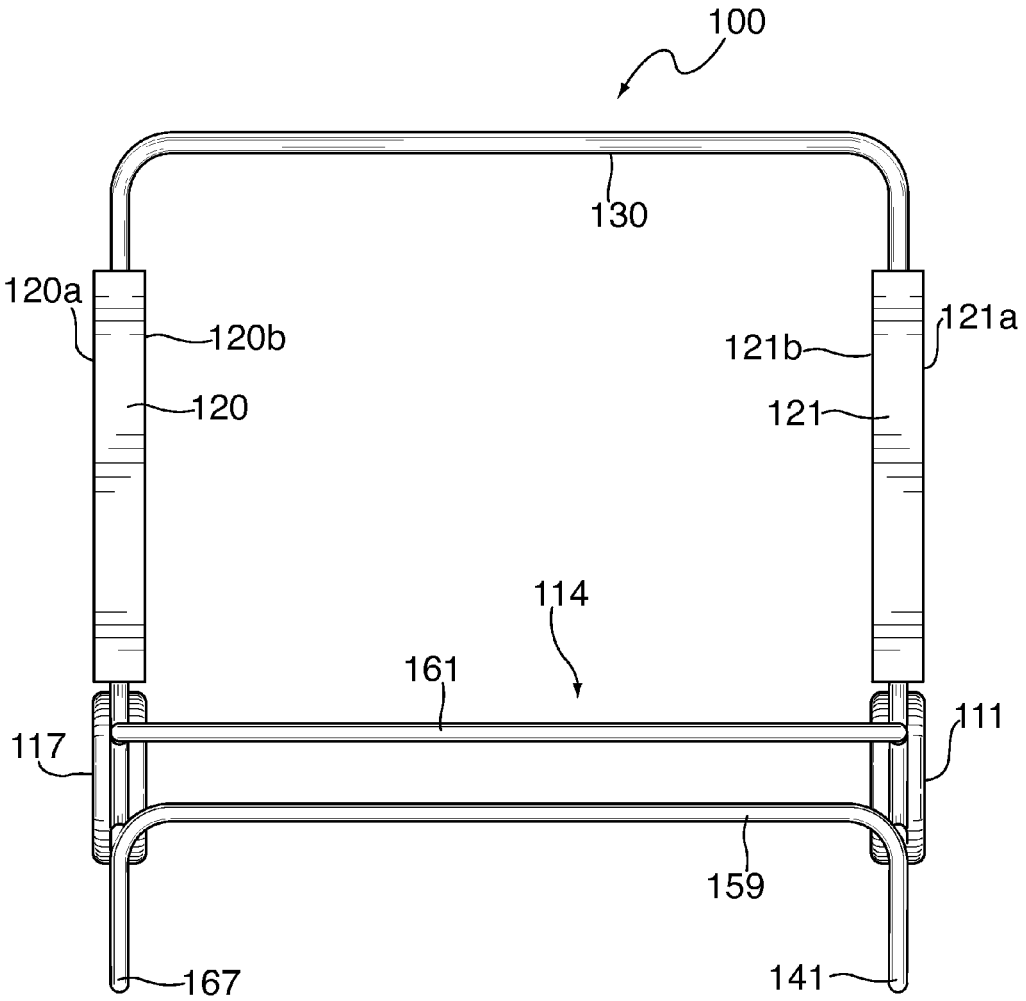
FIG. 6 illustrates a rear view of the shopping cart corral of FIG. 2.
Figure 7:
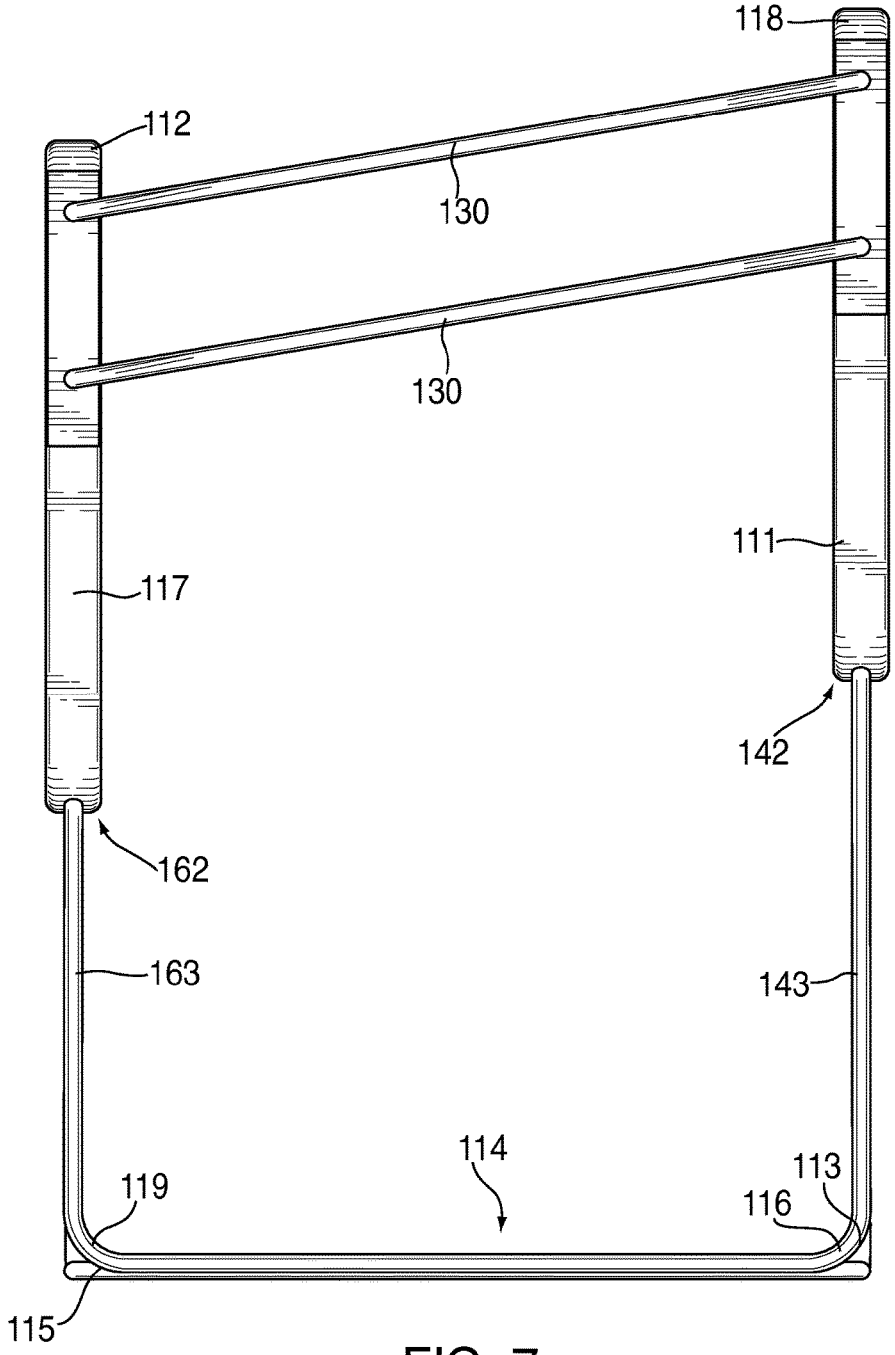
FIG. 7 illustrates an aerial view of the shopping cart corral of FIG. 2.

Turning to the drawings, FIG. 1 illustrates an aerial view of a shopping cart corral with two walls of equal length and two advertisement panels 1 and 2 in an aligned position, such as the corral described in U.S. application Ser. No. 12/456,375, filed Jun. 24, 2009. Advertisement panel 1 has two sides that can display advertisements simultaneously, 1*a* and 1*b*. FIG. 2 illustrates a perspective view of the shopping cart corral with two walls that differ in length and two staggered advertisement panels, according to certain embodiments of the invention. FIG. 3 illustrates an aerial view of the shopping cart corral of FIG. 1 on the right, and a simplified version of the shopping cart corral of FIG. 2 on the left. FIG. 4 illustrates a side view of the shopping cart corral of FIG. 2. FIG. 5 illustrates a front view of the shopping cart corral of FIG. 2. FIG. 6 illustrates a rear view of the shopping cart corral of FIG. 2, and FIG. 7 illustrates an aerial view of the shopping cart corral of FIG. 2.

While the present invention has applicability to all structures or facilities, whether indoors or outdoors, with at least two substantially parallel walls with panels that may display advertisements, such as airport luggage carts, bicycle racks, train or bus stop shelters, and telephone booths, the drawings used to describe the invention depict, by way of example, shopping cart corrals in a parking lot, as discussed below.

FIG. 1 shows a shopping cart corral that has two substantially parallel walls of equal length and two advertisement panels 1 and 2 affixed on its walls in an aligned, substantially parallel fashion. Advertisements can be displayed on either side of the panels, as shown by the sides 1*a* and 1*b* of panel 1. However, the visibility of 1*a* is reduced, if not completely blocked, when a vehicle is parked at the parking space 5, obstructing the view of the advertisement on 1*a* from viewpoint 3. For example, a person approaching the parking space from viewpoint 3 would not be able to see side 1*a* of one panel because the vehicle of space 5 would obstruct the view of the advertisement on side 1*a*, whether the customer attempts to look through line 4 or line 9 of his/her field of vision. In addition, the view of side 1*b* is also obstructed, if not completely blocked, by panel 2 when customers approach from viewpoint 6. For example, a person approaching the parking space from viewpoint 6 would not be able to see side 1*b* of one panel because panel 2 would obstruct the view of the advertisement on side 1*b*, whether the customer attempts to look through line 7 or line 8 of his/her field of vision.

FIG. 3 shows the shopping cart corral in FIG. 1 on the right and a simplified corresponding illustration of an exemplary shopping cart corral according to certain embodiments of the invention on the left for purposes of comparison. Advertisement panels 120 and 121 are affixed on opposite walls of the shopping cart corral in a staggered fashion, as a result of the difference in lengths between the walls. The staggered arrangement provides a clear, unobstructed view of side 121*a* of the advertisement panel 121 when customers approach from viewpoint 3 through line 10 in their field of vision, as a result of the longer wall on which panel 121 is affixed. Also because of the staggered arrangement, customers approaching from viewpoint 6 can now see both sides 120*a* and 121*b* through lines 13 and 11 respectively, because the obstruction from panel 120 is greatly reduced as compared to that from panel 2 on the right hand side of FIG. 3. On the right hand side of FIG. 3, customers can only see panel 2 through line 7 in their field of vision, but not panel 1, as discussed above.

Also because of the longer member on which 121 is affixed, damage to vehicles can be prevented because customers may not always push their shopping carts deep into the enclosure to avoid accidental collision with vehicles. The longer member provides extra protection for the vehicles parked by its side.

FIGS. 2, 4-7 show the detailed construction of the shopping cart corral 100 with the advertisement panels 120 and 121 affixed on the walls of different lengths. The first wall 118 is longer than the second wall 112, resulting in a staggered arrangement of the two walls, and thus, the affixed advertisement panels, that can be used to alleviate the problem shown in FIG. 1. Shopping cart corral 100 is merely exemplary and is not limited to the embodiment presented herein. Structures or facilities with at least advertisement panels 120 and 121 are part of the invention, which can be employed in many different embodiments or examples not specifically depicted or described herein.

As illustrated in FIGS. 2, 4-7, shopping cart corral 100 can include: (a) an enclosure 110; and (b) two or more advertisement panels 120 and 121. Shopping cart corral 100 can be placed in the parking lot of a store to hold shopping carts after customers are finished using the shopping carts.

In various embodiments, enclosure 110 can include: (a) a first side or wall 111 with a first end 118 and a second end 113 opposite first end 118; (b) a second side or wall 114 with a first end 116 and a second end 115 opposite first end 116; (c) a third side or wall 117 with a first end 112 and a second end 119 opposite first end 112; and (d) one or more bar(s) 130. In other examples, enclosure 110 does not include one or more of first wall 111, second wall 114, third wall 117, and bar(s) 130.

First wall 111, second wall 114, third wall 117, and bar(s) 130 can define enclosure 110. Enclosure 110 can have an interior space defined by the interior surfaces of first wall 111, second wall 114, third wall 117, and bar(s) 130. An exterior space can be a space located outside of enclosure 110. Furthermore, enclosure 110 can have an opening 127 configured to receive the one or more shopping carts in the interior space. In some examples, opening 127 can be between first end 118 of first wall 111 and first end 112 of third wall 117.

In certain embodiments, first wall 111 can be coupled to second wall 114. For example, second end 113 of first wall 111 can be coupled to first end 116 of second wall 114. Similarly, second wall 114 can be coupled to third wall 117. For example, second end 115 of second wall 114 can be coupled to second end 119 of third wall 117. Additionally, first wall 111 can be spaced apart from third wall 117 such that two or more shopping carts can be placed between first wall 111, second wall 114, and third wall 117. Bar(s) 130 can couple first wall 111 with third wall 117. In some examples, bar(s) 130 can, along with legs 141 and 167 and walls and panels 111, 121, 120 and 117, act as one integral support system for the corral. Because the corral can be used outdoors and is preferably able to withstand weather conditions, including wind, rain and storms as well as address other issues (such as collisions) that may compromise the structure, the multi-part integral support system shown in the figures and described further below helps increase the strength, stability, and rigidity of the corral.

First wall 111 can include: (a) a leg 141 having a top portion 146 and a bottom portion 145; (b) a barricade section 142 coupled to top portion 146 and advertisement panel 121; and (c) a connector section 143 coupled to barricade section 142 and coupled to first end 116 of second wall 114; and (d) bar(s) 130 for coupling panels 120 and 121 together from the top. Bar(s) 130 can be in the form of a single bar, two or more parallel bars, or two or more bars that are crisscrossed between the two members 111 and 117. In some examples, bottom portion 145 can be configured to rest on a surface (such as, for example, the ground, a parking lot surface, etc.) and at least partially support enclosure 110. In other examples, first wall 111 can have other designs or configurations.

Second wall 114 can include connector sections 159 and 161 with one or more bottom portions 160. In some examples, bottom portions 160 can be part of connector section 159 and configured to rest on a surface and at least partially support enclosure 110. In the example illustrated in FIGS. 2, 4-7, each of connector sections 159 and 161 can include a metal or plastic rod coupled to second end 113 of first wall 111 and second end 119 of third wall 117. In other examples, connector section 161 can have other designs or configurations. For examples, connector section 161 could include a barricade section similar to barricade section 142.

Third wall 117 can be identical or substantially similar to first wall 111. For example, third wall 117 can include: (a) a leg 167 having a top portion 166 and a bottom portion 165; (b) a barricade section 162 coupled to top portion 166 and advertisement panel 120; (c) a connector section 163 coupled to barricade section 162 and coupled to second end 115 of second wall 114; and (d) bar(s) 130 for coupling panels 120 and 121 together from the top. In some examples, bottom portion 165 can be configured to rest on a surface and at least partially support enclosure 110. In other examples, third wall 117 can have other designs or configurations.

In certain embodiments, bar(s) 130, along with legs 141 and 167 and walls and panels 111, 121, 120 and 117, can act as one integral support system for the corral. The integral support structure, which can be in the form of a railing, is formed wherein the bar(s) 130 is/are coupled to the legs 141 and 167 of the first wall 111 and third wall 117 respectively, and the resulting coupled structure goes through the panels 121 and 120, so as to affix the panels on the first and third walls 111 and 117. The multi-part integral support system provides additional strength, stability and rigidity for the corral.

In certain embodiments, legs 141 and 167, connector sections 143 and 163, and/or bar(s) 130 can be at least partially formed using one or more metals, plastics or a combination of metals and plastics. For example, legs 141 and 167, connector sections 143 and 163, and/or bar(s) 130 can be formed from steel or aluminum. In the same example, connector sections 143 and 163 can be formed using one or more plastics, metals, or a combination of plastics and metal.

Advertisement panels 120 and 121 can be considered part of the enclosure 110, and the panels are separable but coupleable to enclosure 110.

Each of advertisement panels 120 and 121 can be configured to display one or more advertisements, including print advertisements. For example, advertisement panels 120 and 121 could display one or more 3 foot by 4 foot poster(s) or one or more 4 foot by 6 foot poster(s).

The owner of the store, parking lot and/or shopping corral can use shopping cart corral 100 as a revenue stream. For example, one or more advertisement panel(s) 120 and 121 can be leased to an advertiser. By leasing one or more advertisement panel(s) 120 and 121 for displaying advertisements, an advertiser can make a commercial impression on a wide variety of pedestrian and vehicular traffic through the parking lot.

The advertisements displayed in panels 120 and 121 can be aesthetically pleasing (i.e., colorful, eye-catching, artistic, etc.) and can improve the overall appearance of the parking lot. As a result, advertising panels 120 and 121 can facilitate attracting additional customers and traffic to the parking lot and/or store.

Advertising panels 120 and 121 can be configured in any shape and/or size. For example, in one embodiment not shown, advertising panels 120 and 121 are configured to have a width approximately equal to the lengths of barricade sections 142 and 162. The advertising panels 120 and 121 can also be configured to be circular, oval-shaped, triangular, as a substantially parallelogram, and/or in any other shapes or sizes.

In certain embodiments, one or more advertisement panel(s) 121 and 120 can be coupled adjacent to first end 118 of first wall 111 and first end 112 of third wall 117 respectively, such that when a vehicle is parked next to corral 100, the vehicle does not block and/or only partially blocks advertisement panels 120 and 121. The coupling of one or more advertising panels 120 and 121 near opening 127 can facilitate better viewing of advertising panels 120 and 121. Such better viewing of advertising panels 120 and 121 can improve the aesthetics of a parking lot. While coupling advertising panels 120 and 121 near opening 127 is described in detail for exemplary corral 100, advertising panels can be similarly coupled near the opening of other types and configurations of corrals.

The first wall 111 is longer than the third wall 117 by the distance as shown in 120*d*, which can vary from a few inches to a few feet. The extra length that the first wall 111 has further enhances visibility of either side of panel 121, as illustrated in FIG. 3. In addition, the longer first wall 111 prevents damage to vehicles because customers may not always push their shopping carts deep into the enclosure 110. The vehicles outside the enclosure on the side of first wall 111 have additional protection because of the extra length of first wall 111.

Moreover, one or more advertising panels 120 and 121 can be coupled to any other portions of a corral as well. For example, in another embodiment, not shown, one or more advertising panels 120 and 121 can be coupled adjacent to first end 116 of second wall 114 and/or second end 115 of second wall 114. For example, advertising panel 120 can be coupled adjacent to second end 115 of second wall 114 and advertising panel 121 can be coupled adjacent to first end 116 of second wall 114.

The owner of shopping cart corral 100 can sell the right to place advertisement in advertisement panels 120 and 121. Thus, shopping cart corral 100 can produce revenues for the store and/or owner of the corral or advertising space. Furthermore, the addition of advertisement panels 120 and 121 provide an unexpected benefit over existing shopping cart corrals. In some examples, the advertisements in advertisement panels 120 and 121 will be routinely updated or changed. Accordingly, shopping cart corral 100 will not be an eyesore or a blemish in the parking lot of the store. The changing advertisement will give shopping cart corral 100 a vibrant, updated, fresh look, not found in existing shopping cart corrals.

In certain embodiments, advertisement panels 120 and 121 can each display two or more advertisements. For example, the at least one advertisement panels 120 and 121 can be configured to hold an advertisement such that the advertisement is visible from a space exterior to the receptacle. That is, for example, advertisement panel 121 can include at least one display 121*a* located at the exterior surface of first wall 111 and at least one other display 121*b* located at the interior surface of first wall 111. In some embodiments, displays 121*a* and 121*b* can include a backing board (e.g., corkboard) surround by a metal or plastic frame with a clear plastic or glass cover. The advertisement(s) in displays 121*a* and/or 121*b* can be viewed through the clear plastic or glass cover. In other embodiments, advertisement panel 121 can include a frame with a clear cover on both the interior and exterior surface. In yet another embodiment, a two-sided advertisement can be placed in advertisement panel 121 and viewed from both the interior and exterior of enclosure 110.

In other examples, advertisement panels 120 and 121 can display electronic and/or multimedia advertisements. For example, one or more of advertisement panels 120 and 121 can include an electronic display configured to display video, electronic images, and/or audio-video advertisements. In yet other examples, one or more of advertisement panels 120 and 121 can include interactive or dynamic advertisements that allow potential customers to interact with the advertisement. For example, advertisement panels 121 could include an electronic advertisement on a screen asking the potential customer to touch a button or the screen to receive a discount on a product (e.g., a coupon). When the user touches the button or the screen, a printer attached to the screen could print the user a coupon or direct the user to go to a location in the adjacent store to receive the product discount.

Figure 8:
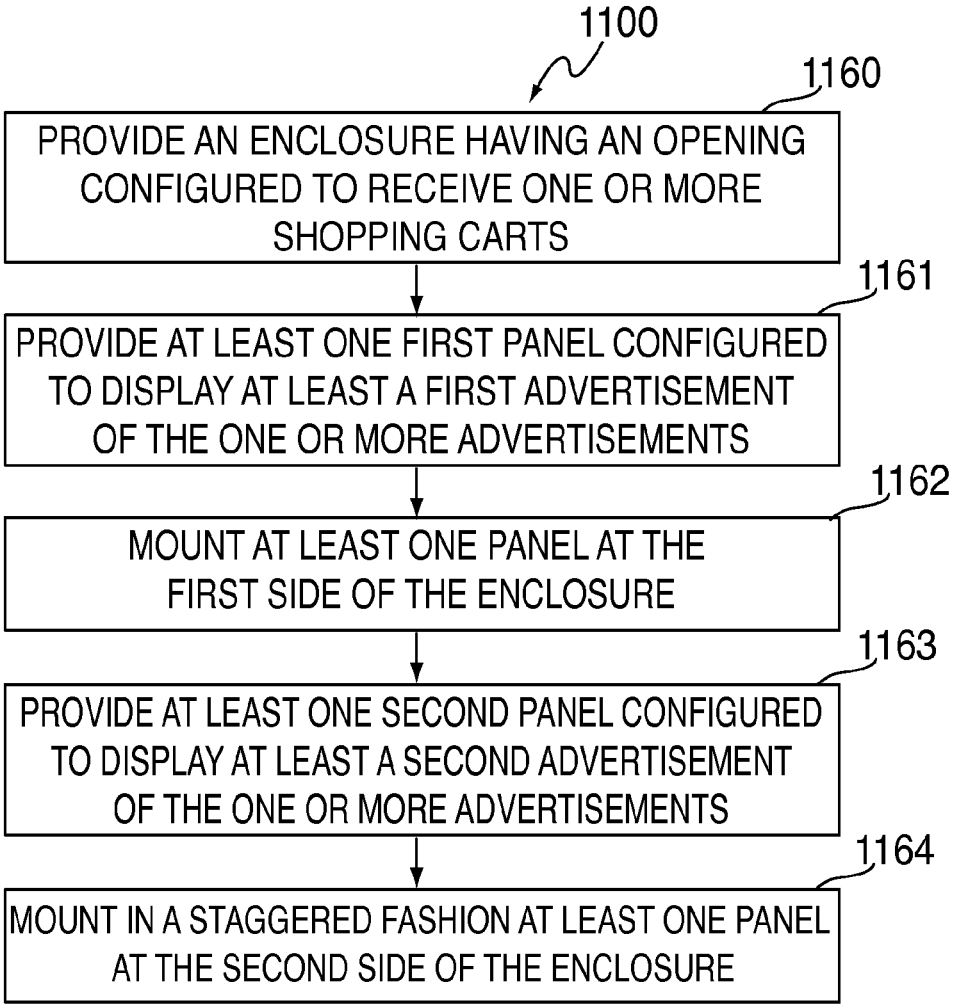
FIG. 8 illustrates a flow chart of a method of providing a shopping cart corral with at least two substantially parallel advertisement panels arranged in a staggered fashion.

FIG. 8 illustrates a flow chart of a method 1100 of providing a corral with at least two substantially parallel walls of different lengths configured to hold one or more shopping cart and display one or more advertisements with at least two staggered advertisement panels, according to certain embodiments.

Method 1100 in FIG. 8 includes an activity 1160 of providing an enclosure having an opening configured to receive the one or more shopping carts. As an example, the enclosure can be identical or similar to enclosure 110 of FIG. 2. The opening in the enclosure can be similar or identical to opening 127 of FIG. 2.

Method 1100 in FIG. 8 continues with an activity 1161 of providing at least one first panel configured to display at least a first advertisement of the one or more advertisements.

As an example, the at least one first panel can be similar or identical to advertisement panel 120 and 121 of FIG. 2.

Subsequently, method 1100 includes an activity 1162 of mounting the at least one first panel at a first side of the enclosure. As an example, the at least one first panel can be mounted at a first side of the enclosure similar or identical to the mounting of advertisement panel 121 at first wall 111 of enclosure 110 as illustrated in FIG. 2.

Next, method 1100 includes an activity 1163 of providing at least one second panel configured to display at least a second advertisement of the one or more advertisements. As an example, the at least one first panel can be similar or identical to advertisement panel 120 and 121 of FIG. 2.

Method 1100 in FIG. 8 continues with an activity 1164 of mounting, in a staggered fashion, at least one second panel at the second side of the enclosure. As an example, the at least one second panel can be mounted at the second side of the enclosure similar or identical to the mounting of advertisement panel 120 at third wall 117 of enclosure 110 as illustrated in FIG. 2.

Figure 9:
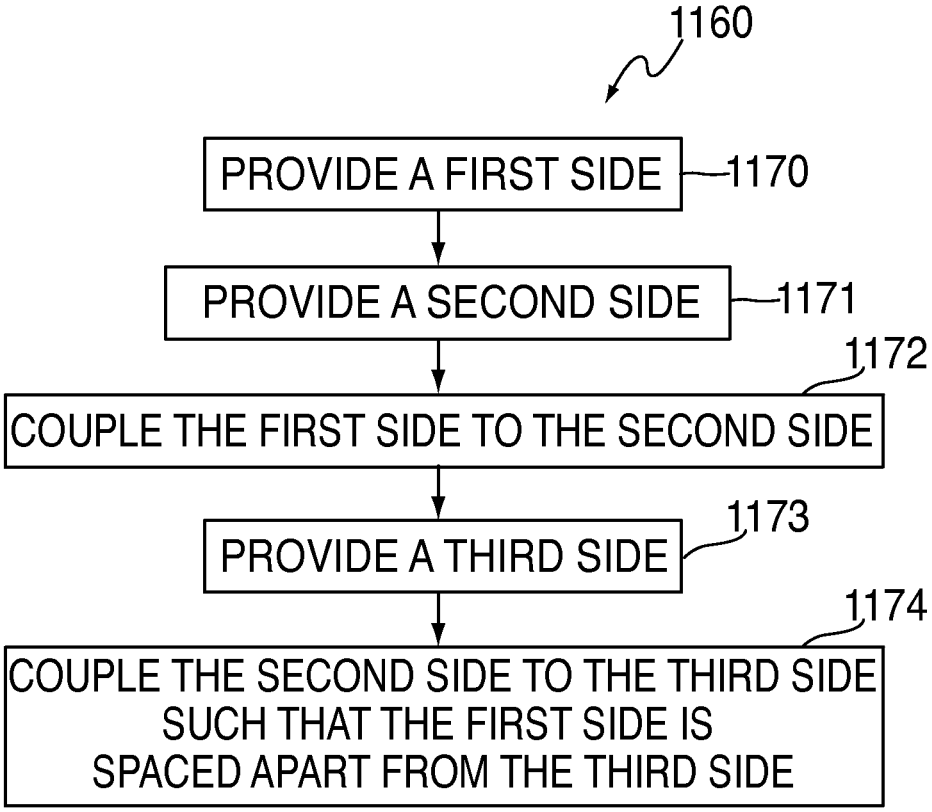
FIG. 9 illustrates a flow chart of an activity of providing an enclosure.

FIG. 9 illustrates a flow chart of activity 1160 of providing the enclosure, according to certain embodiments. Activity 1160 in FIG. 9 includes a procedure 1170 of providing a first side. As an example, the first side can be similar or identical to first wall 111 of FIG. 2.

Subsequently, activity 1160 in FIG. 9 can include a procedure 1171 of providing a second side. As an example, the second side can be similar or identical to second wall 114 of FIG. 2.

Activity 1160 in FIG. 9 can continue with a procedure 1172 of coupling the first side to the second side. As an example, the first side can be coupled to the second side similar or identical to the coupling of first wall 111 to second wall 114, as illustrated in FIG. 2.

Next, activity 1160 in FIG. 9 can include a procedure 1173 of providing a third side. As an example, the third side can be similar or identical to third wall 117 of FIG. 2.

Activity 1160 in FIG. 9 can continue with a procedure 1174 of coupling the second side to the third side such that the first side is spaced apart from the third side. As an example, the second side can be coupled to the third side similar or identical to the coupling of second wall 114 to third wall 117, as illustrated in FIG. 2. After procedure 1174, activity 1160 is complete.

Although the invention has been described with reference to specific embodiments, it will be understood by those skilled in the art that various changes may be made without departing from the spirit or scope of the invention. For example, it will be readily apparent that enclosure 110 can have various designs, components, portions, and/or shapes, not shown in FIGS. 2, 4-7. Accordingly, the disclosure of embodiments is to be illustrative of the scope of the invention and is not intended to be limiting. It is intended that the scope of the invention shall be limited only to the extent required by the appended claims. To one of ordinary skill in the art, it will be readily apparent that the shopping cart corral, the apparatus and method of providing discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A corral configured to hold one or more shopping carts, the corral comprising:

an enclosure defined by three members and having an opening for receiving the one or more shopping carts;

a first member having a first length;

a second member having a second length, wherein the first member and second member are substantially parallel and the first length is not equal to the second length; and a third member coupled to the first member and the second member opposite the opening;

wherein each one of the first member and the second member includes a front bottom portion and rear bottom portion that extend downwardly such that the rear bottom portions of the first and second members are aligned across from one another and the front bottom portions of the first and second members are not aligned across from one another.

2. The corral of claim 1, wherein the front bottom portion of the first member is configured to contact a surface at a first position and the front bottom portion of the second member is configured to contact the surface at a second position, and the second position is located further away from the third member relative to the first position.

3. The corral of claim 1, wherein the corral further comprises a bar member coupled to the first member and the second member near the opening, the bar member being coupled to the first member and the second member such that the bar member is situated at an angle that is not parallel with respect to the third member.

4. The corral of claim 1, wherein the bar member is situated at an angle that is not substantially perpendicular with respect to the first member and second member.

5. The corral of claim 1, wherein the corral further comprises:

a first advertisement coupled to the first member; and a second advertisement coupled to the second member, wherein the first and second advertisements are provided in a staggered arrangement.

6. The corral of claim 1, further comprising at least one advertisement panel that is configured to display one or more advertisements.

7. The corral of claim 1, further comprising an interactive advertisement with which a user may interact to receive a discount or coupon.

8. The corral of claim 1, further comprising:

a first advertisement panel configured to display a first advertisement; and a second advertisement panel configured to display a second advertisement;

wherein a bar member extends through the first panel and the second panel so as to affix the first and second advertisements panels on the first and second members, respectively.

9. The corral of claim 8, wherein a staggered arrangement of the first panel and the second panel permits simultaneous viewing, from a profile view of the corral, of a third advertisement located on an interior surface of the first panel facing the enclosure and the second advertisement located on an exterior surface of the second panel facing away from the enclosure.

10. A method for providing a corral configured to hold one or more shopping carts, the method comprising:

providing an enclosure defined by a first side, a second side and a third side, the enclosure having an opening configured to receive the one or more shopping carts, wherein:

the first side has a first length;

the second side is substantially parallel to the first side and has a second length that is different from the first length; and a third side is coupled to the first side and the second side;

wherein each one of the first side and the second side includes a front bottom portion and rear bottom portion that extend downwardly such that the rear bottom portions of the first and second sides are aligned across from one another and the front bottom portions of the first and second sides are not aligned across from one another.

11. The method of claim 10, wherein the front bottom portion of the first side is configured to contact a surface at a first position and the front bottom portion of the second side is configured to contact the surface at a second position, and the second position is located further away from the third side relative to the first position.

12. The method of claim 10, wherein the corral further comprises a bar coupled to the first side and the second side near the opening, the bar being coupled to the first side and the second side such that the bar is situated at an angle that is not parallel with respect to the third side.

13. The method of claim 10, wherein the bar is situated at an angle that is not substantially perpendicular with respect to the first side and second side.

14. The method of claim 10, wherein the corral further comprises:

a first advertisement coupled to the first side; and a second advertisement coupled to the second side, wherein the first and second advertisements are provided in a staggered arrangement.

15. The method of claim 10, further comprising at least one advertisement panel that is configured to display one or more advertisements.

16. The method of claim 10, further comprising an interactive advertisement with which a user may interact to receive a discount or coupon.

17. The method of claim 10, further comprising:

a first advertisement panel configured to display a first advertisement; and a second advertisement panel configured to display a second advertisement;

wherein a bar extends through the first panel and the second panel so as to affix the first and second advertisements panels on the first and second sides, respectively.

18. The method of claim 17, wherein a staggered arrangement of the first panel and the second panel permits simultaneous viewing, from a profile view of the corral, of a third advertisement located on an interior surface of the first panel facing the enclosure and the second advertisement located on an exterior surface of the second panel facing away from the enclosure.

* * * * *